United States Patent [19]

Huppertsberg

[11] Patent Number: 4,712,513

[45] Date of Patent: Dec. 15, 1987

[54] SUSPENSION HARNESS

[75] Inventor: Frank Huppertsberg, Wuppertal, Fed. Rep. of Germany

[73] Assignee: Gebr. Wahlefeld GmbH & Co. KG, Krefeld-Linn, Fed. Rep. of Germany

[21] Appl. No.: 854,396

[22] Filed: Apr. 21, 1986

[30] Foreign Application Priority Data

Apr. 22, 1985 [DE] Fed. Rep. of Germany ... 8511916[U]

[51] Int. Cl.[4] ..... A62B 35/00; A63B 79/00

[52] U.S. Cl. ..... 119/96; 182/3; 244/151 R

[58] Field of Search ..... 119/96; 182/3–9; 244/151 R

[56] References Cited

U.S. PATENT DOCUMENTS

| | | | |
|---|---|---|---|
| 1,357,772 | 11/1920 | Godwin | 244/151 R |
| 1,697,363 | 1/1929 | Losey | 119/96 |
| 1,939,062 | 12/1933 | Knight | 119/96 X |
| 3,176,793 | 4/1965 | Hlacia | 119/96 X |
| 4,273,215 | 6/1981 | Leggett | 119/96 X |
| 4,632,217 | 12/1986 | Markwell et al. | 182/3 |

FOREIGN PATENT DOCUMENTS

| | | | |
|---|---|---|---|
| 2427828 | 2/1980 | France | 182/3 |
| 338961 | 3/1936 | Italy | 182/3 |
| 2039209 | 8/1980 | United Kingdom | 182/3 |

OTHER PUBLICATIONS

Atlas Safety Equipment Co., Inc., Catalogue 65, p. 8.

*Primary Examiner*—Carl D. Friedman
*Assistant Examiner*—Richard E. Chilcot, Jr.
*Attorney, Agent, or Firm*—Karl F. Ross; Herbert Dubno

[57] ABSTRACT

A suspension harness utilizes a continuous belt of adjustable effective length which is affixed to the seat strap and passes crosswise through a rear plate to form the shoulder straps of the harness. The passes of the continuous belt then extend downwardly to loop through rigid frames connected to the seat strap ends before passing upwardly through a front frame. The rear plate and front frame alone or together with the lateral frames can have catch eyes.

15 Claims, 4 Drawing Figures

SUSPENSION HARNESS

FIELD OF THE INVENTION

My present invention relates to a suspension harness and, more particularly, to a safety, transport and lifting or lowering harness for a person, the harness having a seat portion and a shoulder portion.

BACKGROUND OF THE INVENTION

Harnesses of the aforedescribed type are widely used for the lifting and lowering of individuals in dangerous situations and as rescue equipment, for operations, which require an individual to be suspended from an elevated point for work at a location below that point, or generally as a suspension harness which facilitates an activity of the individual. The harness can also be used, of course, in parachute applications, in mountain climbing and in numerous other applications in which total suspension support of the entire body must be ensured when the harness is engaged by a catch or the like.

Such harnesses can comprise adjustable shoulder straps which can be guided through a plate formed on a rear part of the harness and referred to hereinafter as a rear plate, the shoulder straps then reaching forwardly to be activated with a seat strap upon which the hindquarters of the supported person can rest, the legs of the supported individual passing through adjustable leg loops formed by leg straps connected to the seat strap.

Such harness constructions have been designed in various configurations and the basic elements of such harness can be found in the German Industrial Standard DIN 7478. At the front part of the harness, the shoulder straps are held by a chest strap or strut and are connected rearwardly in the region of the rear plate, which is provided with a suspension eye engageable with a hook or the like, the shoulder straps being joined to form the back piece of the harness. The seat strap with the leg loops can be connected to the chest strap.

The chest strap can have further, usually laterally arranged, eyes which can be used to suspend a further flexible member from the harness or to suspend the harness from a flexible member.

It is customary to connect the straps to the chest strap. This, however, causes problems when the harness is not set to the size of the individual for which it is intended. If there is poor adjustment to the size of the individual, the harness is not only uncomfortable but can produce shocks on the body which are concentrated in certain shoulder regions or seat regions and are not uniformly distributed so that they are particularly discomforting and even dangerous.

Earlier harnesses of the type described required several adjustments of the load-carrying or shock transferring portions of the harness to be certain that the same was adjusted to the particular individual.

OBJECTS OF THE INVENTION

The principal object of the present invention is to provide an improved suspension harness which will obviate the drawbacks mentioned above.

Another object of this invention is to provide an improved suspension harness which does not require preadjustment of numerous elements to a particular individual but can be adjusted simply and quickly with a single adjustment for practically all sizes of individuals for which the harness is intended.

SUMMARY OF THE INVENTION

These objects and others which will become apparent hereinafter are attained, in accordance with the present invention in a harness of the type described initially but wherein the shoulder straps are formed by a single continuous belt interrupted by a buckle ( and made up of two straps) which is adjustable in its effective length and which passes not only though the rear plate as has been described, but also through a front plate which can be formed with a suspension eye and passes continuously through loops or frames fixed on the ends of the seat strap.

Advantageously, two passes of the continuous belt, which can be stitched to the seat strap adjacent the aforementioned ends thereof, give rise to respective oppositely extending passes of the continuous belt, these passes being threaded through respective slots in the rear plate and crossing thereon one behind the other.

With the system of the invention, simply by adjusting the effective length of the continuous belt, it is possible to adjust the entire harness to the body size of the individual using the same since the continuous belt not only can shorten the height of the harness by drawing the seat strap toward the shoulder straps, but can draw the sides of the harness toward one another to accommodate a smaller individual when the continuous belt is effectively shortened. The shoulder straps are thus ensured of lying uniformly against the shoulders while the seat strap engages the hindquarters of the individual equally uniformly.

Advantageously, the passes of the continuous belt extend forwardly from the rear plate to form the shoulder straps and then pass downwardly on opposite sides of the front part of the harness, to loop through the frames on the free ends of the seat strap and then extend toward the front plate, the continuous belt being looped through the latter as well.

In addition, a chest strut or strap can be provided which is passed through one or more slots of the front plate and has its ends stitched to the continuous belt at the front part of the shoulder straps thereof. The chest strap, without causing loss of any of the advantages enumerated above, provides a further guarantee of uniform distribution of any shock forces to the chest, shoulders and seating regions of the individual.

The fixed terminuses of the continuous belt can be stitched to the free end of the seat strap adjacent the frames or loops which are fixed thereto.

The device for adjusting the effective length of the continuous belt and, indeed, the devices for adjusting the sizes of the leg loops and hence the effective lengths of the leg straps can be clamp buckles or pin buckles.

Preferably both plates have suspension eyes as described and, of course, additional suspension eyes or catch eyes for suspension hooks can be provided as required, especially laterally on the frames or rigid loops.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
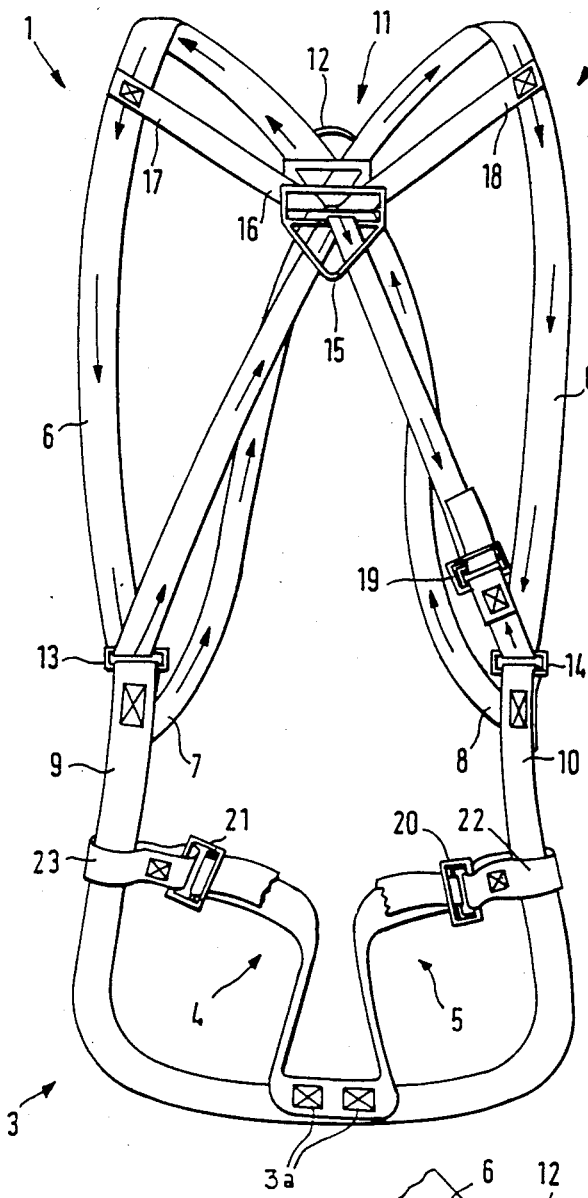
FIG. 1 is an elevational view in somewhat diagrammatic form of a suspension harness according to the invention.

The harness of the invention basically comprises two adjustable shoulder straps 1, 2 and a seat strap 3 with adjustable leg loops or straps 4 and 5.

The shoulder straps 1 and 2 are formed by a single continuous belt 6 whose opposite terminuses 7, 8 are stitched to ends 9 and 10 of the seat strap 3.

From these terminuses, the passes of the continuous belt extend in a crosswise manner, one behind the other, through respective sets of slots 24 in a rear plate 11 (FIG. 2) provided with a catch eye 12 for a suspension cable, rope or the like.

From the rear plate 11, the opposite passes of the continuous belt 6 extend forwardly to form the shoulder straps 1, 2 (see the arrows in FIG. 1) and then downwardly along opposite sides of the harness to engage in rigid metal loops, rings or frames 13, 14 which are fixed to the opposite ends 9 and 10 of the seat strap 3.

From these loops 13 and 14, the passes of the continuous belt reach toward the front plate which is formed as a frame 15 and can also be provided with an eye as illustrated.

Since the belt 6 passes through the frames 13, 14 and 15 continuously, a single adjustment of the effective length of the belt 6 can narrow or widen the harness and at the same time shorten or lengthen the harness and thereby accommodate it to practically any individual size.

The frame 15 is also traversed by a chest strut or strap 16 whose ends 17 and 18 are sewn onto the shoulder straps 1 and 2.

Figure 3:
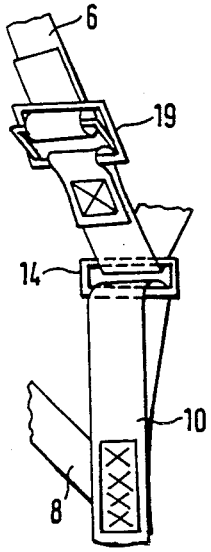
FIG. 3 is a diagrammatic perspective view showing the use of a clamp buckle according to the invention.

The length adjustment for the continuous belt 6 can be of a clamp buckle configuration as shown at 19 in FIGS. 1 and 3 so that at least one extremity of the two extremities into which the stretch of the continuous belt 6 between frames 14 and 15 is divided, can be adjustably clamped, when desired to vary the length of the belt.

Figure 4:
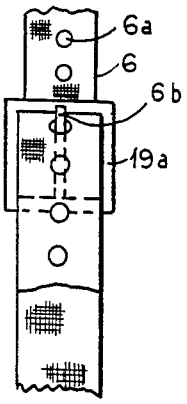
FIG. 4 is a diagrammatic elevational view showing the use of a pin buckle for the purposes of the invention.

Alternatively, the belt 6 can have one extremity provided with holes **6*a* engageable by a pin 6*b* of pin type buckle 19*a* forming the length-adjustment means (FIG. 4**).

The leg loops 4 and 5 can be centrally fixed to the seat strap 3 by stitching at **3*a* and can have clamp buckles 20 and 21 for adjusting the lengths of these loops utilizing the principle of the buckle 19 previously described. Strap loops 22 and 23** permit the ends of the lug straps to ride along the ends of the seat strap.

Figure 2:
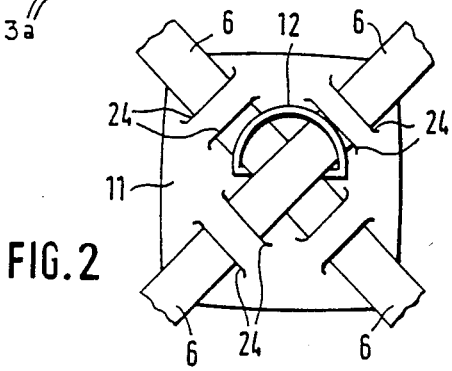
FIG. 2 is a diagrammatic elevational view, greatly enlarged in scale by comparison with FIG. 1, of a rear plate in accordance with the invention.

FIG. 2 clearly shows that the rear plate 11 has diametrically oppositely arranged pairs of slots to allow the passes of the continuous belt 6 to cross one behind the other. Additional catch eyes can be formed on the lateral frames 13 and 14 if desired.

I claim:

1. In a suspension harness with adjustable shoulder straps which pass through a plate at a rear part of the harness having a suspension eye and are connected to a seat strap with adjustable leg straps at a front part of the harness, the improvement wherein:

said shoulder straps are formed by a single continuous belt passing in two directions through said plate at said rear part of the harness and passing additionally through a plate at the front part of the harness located generally opposite the plate at the rear part;

said belt is provided with means for adjusting the effective length thereof; and said seat strap has loops at opposite ends thereof through which respective passes of said belt are looped at opposite sides of the harness.

2. The improvement defined in claim 1 wherein said continuous belt has two passes one crossing behind the other, on said plate at said rear part of the harness.

3. The improvement defined in claim 1 wherein said continuous belt has opposite terminuses each secured to said seat strap at a respective one of said opposite ends thereof.

4. The improvement defined in claim 3 wherein said continuous belt has two passes extending from said terminuses and passing through said plate at said rear part of the harness and crossing one behind the other on said plate at said rear part of the harness.

5. The improvement defined in claim 4 wherein said passes of said continuous belt which cross one behind the other on said plate at said rear part of the harness extend forwardly to become said shoulder straps and then extend downwardly along said opposite sides of said harness to pass through the respective loops at said opposite ends of said seat strap, before said continuous belt passes through said plate at said front part of the harness.

6. The improvement defined in claim 5, further comprising a flexible chest strut passing through said plate at said front part of said harness and having respective ends fixed to said shoulder straps.

7. The improvement defined in claim 6 wherein said strut is stitched to said shoulder straps.

8. The improvement defined in claim 7 wherein said terminuses of said continuous belt are stitched to said seat strap at said ends thereof.

9. The improvement defined in claim 1 wherein said terminuses of said continuous belt are stitched to said seat strap at said ends thereof.

10. The improvement defined in claim 8 wherein said continuous belt has its effective length axially adjustable by a buckle interconnecting opposite extremities of said continuous belt.

11. The improvement defined in claim 1 wherein said continuous belt has its effective length axially adjustable by buckle interconnecting opposite extremities of said continuous belt.

12. The improvement defined in claim 11 wherein said buckle is a clamping buckle.

13. The improvement defined in claim 11 wherein said buckle is a pin buckle having a pin engaging in holes of said belt.

14. The improvement defined in claim 10 wherein said buckle is a clamping buckle.

15. The improvement defined in claim 10 wherein said buckle is a pin buckle having a pin engaging in holes of said belt.

* * * * *